US007731338B2

(12) United States Patent
Min et al.

(10) Patent No.: US 7,731,338 B2
(45) **Date of Patent: *Jun. 8, 2010**

(54) INK-JET PRINTER HEAD HAVING LAMINATED PROTECTIVE LAYER AND METHOD OF FABRICATING THE SAME

(75) Inventors: Jae-sik Min, Suwon-si (KR); Young-ung Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 367 days.

This patent is subject to a terminal disclaimer.

(21) Appl. No.: 11/763,747

(22) Filed: Jun. 15, 2007

(65) Prior Publication Data

US 2007/0236529 A1 Oct. 11, 2007

Related U.S. Application Data

(63) Continuation-in-part of application No. 10/997,977, filed on Nov. 29, 2004, now Pat. No. 7,296,880.

(30) Foreign Application Priority Data

Dec. 26, 2003 (KR) ..... 2003-97576

(51) Int. Cl.
*B41J 2/05* (2006.01)

(52) U.S. Cl. ..... 347/63; 347/64; 347/62

(58) Field of Classification Search ..... 347/20, 347/44, 47, 56–69
See application file for complete search history.

(56) References Cited

U.S. PATENT DOCUMENTS 4,951,063 A * 8/1990 Hawkins et al. ..... 347/62
4,968,992 A * 11/1990 Komuro ..... 347/64
5,045,870 A 9/1991 Lamey et al.
5,870,121 A 2/1999 Chan
6,848,772 B2 2/2005 Kim (Continued)

FOREIGN PATENT DOCUMENTS

JP 59-201868 11/1984

(Continued)

OTHER PUBLICATIONS

Office Action issued Feb. 5, 2008, from Japanese Patent Office with respect to Japanese Patent Application No. 2004-376466, filed on Dec. 27, 2004.

*Primary Examiner*—Juanita D Stephens
(74) *Attorney, Agent, or Firm*—Stanzione & Kim LLP

(57) ABSTRACT

A heat transfer type ink-jet print head and a method of fabricating the same. A method of fabricating an ink-jet print head includes sequentially laminating a heat generation layer and an electrode layer on a substrate, laminating a protective layer on the top surfaces of the electrode layer and the heat generation layer by sequentially laminating a first protective layer and a second protective layer on the top surfaces of the electrode layer and the heat generation layer, and laminating an ink chamber barrier and a nozzle plate on the top surface of the protective layer to form an ink chamber to prevent defects such as "pin-holes" from being generated during the formation of the first protective layer.

11 Claims, 11 Drawing Sheets

U.S. PATENT DOCUMENTS 7,296,880 B2 * 11/2007 Min et al. ..... 347/63

FOREIGN PATENT DOCUMENTS

| | | |
|---|---|---|
| JP | 04-029319 | 1/1992 |
| JP | 04-39064 | 2/1992 |
| JP | 6-8441 | 1/1994 |
| JP | 07-314684 | 12/1995 |
| JP | 11-334075 | 12/1999 |
| JP | 2000-015809 | 1/2000 |
| JP | 2002-217290 | 8/2002 |
| KR | 960026105 | 6/1996 |

* cited by examiner

INK-JET PRINTER HEAD HAVING LAMINATED PROTECTIVE LAYER AND METHOD OF FABRICATING THE SAME

CROSS-REFERENCE TO RELATED APPLICATIONS

This application is a continuation-in-part of prior application Ser. No. 10/997,977, filed Nov. 29, 2004, now U.S. Pat. No. 7,296,880 in the U.S. Patent and Trademark Office, which claims the benefit under 35 U.S.C. §119 of Korean Patent Application No. 2003-97576, filed on Dec. 26, 2003, in the Korean Intellectual Property Office, the disclosures of which are incorporated herein in their entirety by reference.

BACKGROUND OF THE INVENTION

1. Field of the Invention

The present general inventive concept relates to an ink-jet print head, and more particularly, to a thermal transfer type ink-jet print head having a protective layer to protect a heat generation layer, and a method of fabricating the same.

2. Description of the Related Art

Conventionally, an ink-jet print head may be classified into a piezoelectric type, which ejects ink using a piezoelectric member, and a heat transfer type, which ejects ink using bubbles generated when the ink is instantly heated by a heat generation member.

FIG. 1 illustrates a conventional heat transfer type ink-jet print head.

Referring to FIG. 1, a conventional ink-jet print head 100 includes substrate 110, an insulating layer 120, a heat generation layer 130, an electrode layer 140, a protective layer 150, a chamber layer 180, and a nozzle layer 190 having a nozzle 195. The heat generation layer 130 functions to instantly heat ink filled in an ink chamber 115, and the electrode layer 140 functions to apply electric power to the heat generation layer 130.

The protective layer 150 functions to protect the heat generation layer 130. The conventional protective layer 150 includes a first protective layer 160 and a second protective layer 170 sequentially laminated on top surfaces of the heat generation layer 130 and the electrode layer 140, as disclosed in U.S. Pat. No. 4,335,389. The second protective layer 170 functions to prevent a failure of the heat generation layer 130, which is caused by a cavitation force generated when bubbles formed within the ink chamber 115 are contracted after the ink is ejected. In general, the second protective layer 170 is formed by depositing tantalum (Ta) or tantalum nitride (TaNx) on the top surface of the first protective layer 160.

In addition, the first protective layer 160 functions to electrically insulate the heat generation layer 130 and the electrode layer 140, and is formed by depositing silicon oxide (SiOx) or silicon nitride (SiNx) on the top surfaces of the heat generation layer 130 and the electrode layer 140. Conventionally, the SiNx layer is deposited through a plasma enhanced chemical vapor deposition (PECVD) process, and the thickness of the single SiNx deposited is about 6,000 Å.

However, the conventional first protective layer 160 formed as described above has defects, such as fine holes usually called "pinholes," formed at the time of forming the protective layers. In particular, these pinholes are inevitably formed due to characteristics of the conventional process of forming such a protective layer and a material thereof. When the ink-jet print head 100 is operated for an extended period of time, the above-mentioned pinholes principally contribute to cause a failure of the first protective layer 160 due to the cavitation force. Such a failure of the first protective layer 160 is more frequently produced at an area C where the heat generation layer 130 and the electrode layer 140 are joined to one another forming a step being between them. For example, a portion including the pinholes has a poor mechanical rigidity, and may act as a point at which cracks occur when the cavitation force is exerted. As such, if the first protective layer 160 suffers a failure, the heat generation layer 130 may also suffer a failure by the cavitation force. In addition, the heat generation layer 130 may be electrically shorted with the second protective layer 170 or the ink may contact the heat generation layer 130 through a damaged part of the first protective layer 160. As a result, a duration and/or quality of the ink-jet print head will be deteriorated and defects (pinholes) in the first protective layer 160 are closely associated with the duration of the heat generation layer 130.

SUMMARY OF THE INVENTION

Accordingly, the present general inventive concept provides a thermal type inkjet print head having a protective layer devoid of pinholes, and a method to fabricate the same.

The present invention also provides a method to improve an adhesiveness between the protective layer and the heat generation and electrode layers.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a method of fabricating an ink-jet print head, including preparing a main substrate, sequentially forming a heat insulation layer, a heat generating material layer, and an electrode layer on the main substrate, patterning the electrode layer to expose a portion of the heat generating material layer, forming a first protective layer in a manner such that the first protective layer has a plurality of thin films and is laminated on the electrode layer, and laminating a chamber barrier and a nozzle plate on a top surface of the second protective layer to define an ink chamber and a nozzle.

The plurality of thin films may be formed from SiNx by separate depositing, and treated by a plasma enhanced chemical vapor deposition (PECVD) process so that the thin films are devoid of pinholes.

The first protective layer may be laminated on top surfaces of the heat generation layer, the electrode layer and the main substrate, which are plasma surface treated using ammonia ($NH_3$), so that each SiNx thin film is more adhesive to the substrate and the nitrified surface serves as a seed layer of the subsequent SiNx thin film to prevent an initial generation of pinholes.

Each separately deposited SiNx thin film may have a thickness in the range of about 100~3000 Å during one time deposition.

The plurality of thin films may be treated by $NH_3$ plasma stuffing process so that the thin films are devoid of pinholes.

The method may further include laminating a second protective layer on the first protective.

The chamber barrier can be formed integrally with the nozzle plate.

The foregoing and/or other aspects and utilities of the present general inventive concept are also achieved by providing an ink-jet print head including a main substrate, an ink chamber formed on the main substrate, a heat generation layer laminated on a bottom surface of the ink chamber, an electrode layer laminated on a top surface of the heat generation layer, and a protective layer laminated on top surfaces of the electrode layer and the heat generation layer, wherein the protective layer comprises a first protective layer laminated on the top surfaces of the heat generation layer and the electrode layer and a top surface of the first protective layer is subject to surface treatment by applying a plasma thereto to remove pinholes from the top surface of the first protective layer so that the top surface is devoid of pinholes.

The first protective layer may include at least two films sequentially laminated on the top surfaces of the heat generation layer and the electrode layer, and top surfaces of the at least two films are respectively subject to surface treatment by applying a plasma to the top surfaces thereof.

All of the at least two films essentially may essentially consist of SiNx, and a reaction gas used when applying the plasma may be ammonia ($NH_3$).

The heat generation layer and the electrode layer may have been subjected to surface treatment to remove pinholes by applying the plasma to the top surfaces thereof.

Each of the at least two films may have a thickness in the range of about 100~1100 Å.

The protective layer may further include a second protective layer laminated on the top surface of the first protective layer.

The second protective layer may include at least two films formed from different materials, wherein the at least two films are alternately laminated on the top surface of the first protective layer.

The second protective layer may include plural first films and plural second films alternately laminated on the top surface of the first protective layer, wherein the first films essentially consist of Ta and the second films essentially consist of TaNx, and wherein the uppermost and the lowermost of the second protective layer are formed with the second films.

The foregoing and/or other aspects and utilities of the present general inventive concept are also achieved by providing an ink-jet print head including a main substrate, an ink chamber formed on the main substrate, a heat generation layer formed on a bottom surface of the ink chamber, an electrode layer formed on a top surface of the heat generation layer, and a plurality of first protective layers formed on top surfaces of the electrode and heat generation layer, wherein the top surface of each of the plurality of first protective layers is devoid of pinholes.

The ink-jet head may further include a plurality of second protective layers formed on a top surface of the plurality of first protective layers, comprising at least two different materials.

The plurality of second protective layers may include a plurality of first films comprising a first material, and a plurality of second films comprising a material different from the first material, alternately laminated on the top surface of the first protective layer.

The uppermost layer and the lowermost layer of the plurality of second protective layers may be formed with the same material.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
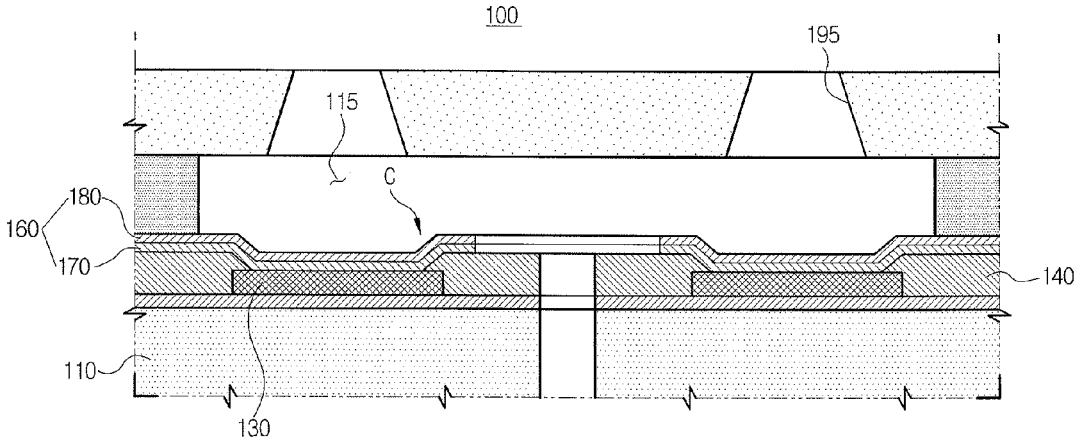
FIG. 1 (PRIOR ART)
FIG. 1 is a cross-sectional view illustrating a conventional ink-jet print head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
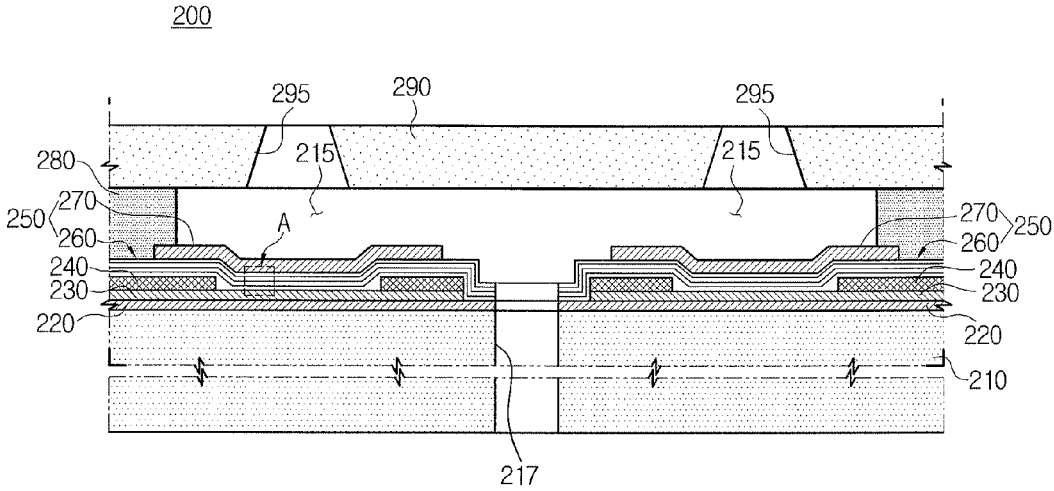
FIG. 2 is a cross-sectional view illustrating an ink-jet print head according to an embodiment of the present general inventive concept.

FIG. 2 illustrates an ink-jet print head according to an embodiment of the present general inventive concept. Referring to FIG. 2, an ink-jet print head 200 may include a main substrate 210, a heat insulation layer 220, a heat generation layer 230, an electrode layer 240, a protective layer 250, an ink chamber barrier 280, and a nozzle plate 290.

The heat generation layer 230 functions to instantly heat the ink filled in ink chambers 215, which are defined by the ink chamber barrier 280 and the nozzle plate 290, and the heat generation layer 230 can be formed of a tantalum-aluminum alloy (Ta—Al alloy). The heat insulation layer 220, which can be formed of $SiO_2$, is interposed between the heat generation layer 230 and the main substrate 210, whereby heat transfer from the heat generation layer 230 to the main substrate 210 can be prevented.

The electrode layer 240 functions to supply electric power to the heat generation layer 230, and the electrode layer 240 can be formed of aluminum (Al), which has a high electric conductivity.

Meanwhile, the protective layer 250 may include a first protective layer 260 and a second protective layer 270. Here, the second protective layer 270 functions to prevent a failure of the heat generation layer 230 caused by a cavitation force generated when bubbles (not illustrated) are contracted within the ink chamber 215 after ink ejection through a nozzle 295 is completed. The second protective layer 270 also functions to prevent the heat generation layer 230 from being oxidized by ink supplied into the ink chamber 215. In addition, the first protective layer 260 functions not only to prevent the failure and oxidization of the heat generation layer 230 as does the second protective layer 270, but also to prevent the heat generation layer 230 from being electrically shorted with the first protective layer 260 or ink supplied into the ink chamber 215. Accordingly, the first protective layer 260 may be referred to as an insulation layer or a dielectric layer.

Figure 3:
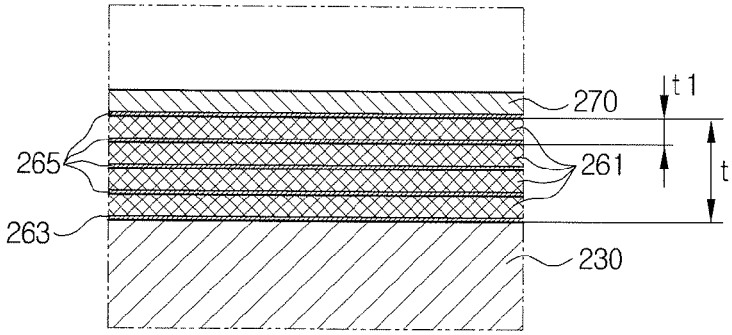
FIG. 3 is an enlarged view illustrating part A of FIG. 2.

As illustrated in FIG. 3, the first protective layer 260 according to the present embodiment is subjected to separate processes to remove any defects, such as pinholes, from the first protective layer 260. According to the present general inventive concept, any defect present in the first protective layer 260 is removed by a plasma applied to the top surface of the first protective layer 260. Such a process to remove defects in this manner is called a "stuffing treatment." The thickness of the first protective layer 260 to effectively execute the stuffing treatment using the plasma is about 1000 Å. However, considering the heat transfer efficiency and insulation efficiency of the first effective layer 260, the total thickness of the first protective layer 260 is typically in the range of about 3000~7000 Å. In order to prohibit the deterioration in efficiency of the stuffing treatment due to this, the first protective layer 260 in this embodiment is formed by sequentially laminating plural films 261 to form the first protective layer 260, and the top surface of each film is subject to stuffing treatment before the next film is deposited. In addition, it is possible that a thickness t1 of each film ranges between 100~1100 Å to improve an efficiency of removing defects by the stuffing treatment as described above. This is because if a film 261 is formed too thick during a single lamination process, the effect of removing defects by applying the plasma as described above is only effective on the surface of the film 261. In this embodiment, a total of four films 261 are laminated in a thickness t1 of about 800 Å, respectively, thus forming a first protective layer 260. Accordingly, the total thickness t of the first protective layer 260 is about 3200 Å.

Meanwhile, the respective films 261 may be formed from a same material, in particular, a material selected from SiOx and SiNx, which have a good insulation property. The first protective layer 260 in this embodiment is formed by separately depositing SiNx, which is superior to SiOx in heat conductivity, through a plasma enhanced chemical vapor deposition (PECVD) process. Because the films 261 are respectively formed by depositing SiNx as described above, it is possible to introduce gaseous ammonia ($NH_3$) into the reaction area when applying the plasma as a reaction gas. Although reference numerals 265 in FIG. 3 appear to be formed layers, these reference numerals (265) are only provided to aid in pointing out where the stuffing treatment occurs, and no practical layer is formed by such stuffing treatment.

According to the present embodiment, it is possible that the first protective layer 260 is laminated on the top surfaces of the heat generation layer 230 and the electrode layer 240 after the top surfaces have been treated by applying the plasma. Here, it is more preferable that gaseous ammonia ($NH_3$) can be introduced into a reaction area on the top surfaces of the heat generation layer 230 and the electrode layer 240 at the time of applying the plasma, thereby using the ammonia as the reaction gas. The top surfaces of the heat generation layer 230 and the electrode layer 240 treated in this manner serve as seed layers to improve a bonding force between the top surfaces of the heat generation layer 230 and the electrode layer 240 and the first protective layer 260 and to allow the films 261 to be more tightly laminated. Although reference numeral 263 in FIG. 3 appears to be a formed layer, this reference numeral 263 is only provided to aid in pointing out where the stuffing treatment occurs, and no practical layer is formed by such stuffing treatment.

Hereinbelow, a method of fabricating the ink-jet print head according to an embodiment of the present general inventive concept is described in detail with reference to the accompanying drawings.

Figure 4A:
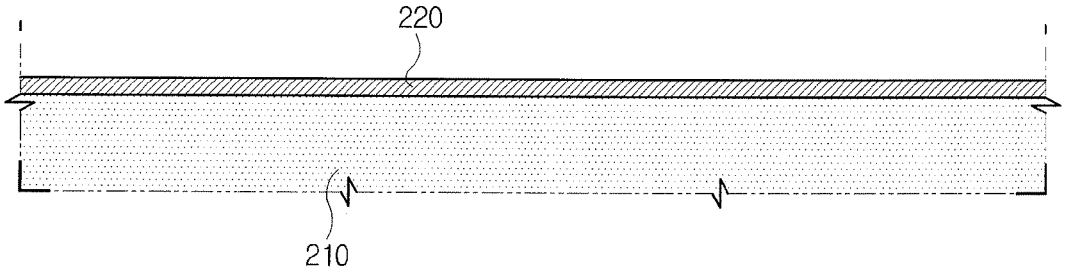
FIGS. 4A to 4M illustrate a process of fabricating the ink-jet print head according to an embodiment of the present general inventive concept.

At first, as illustrated in FIG. 4A, a heat insulation layer 220 is formed on a main substrate 210.

Figure 4B:
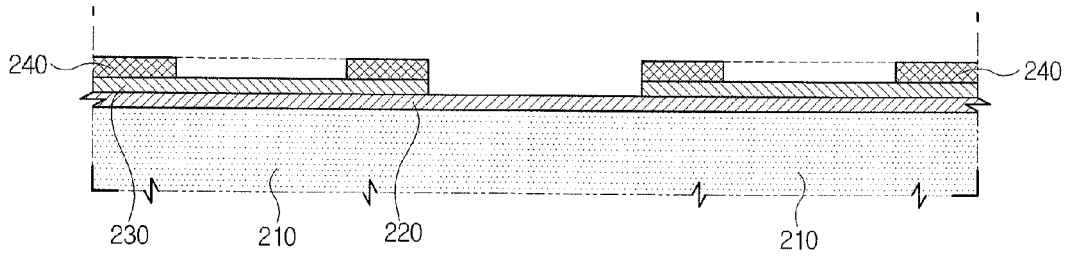

Then, as illustrated in FIG. 4B, a heat generation layer 230 and an electrode layer 240 are formed on a top surface of the heat insulation layer 220 at which point the electrode layer 240 is patterned through an etching process, such as lithography, to expose some areas of the top surface of the heat generation layer 230 at the bottom surface of an ink chamber 215. Here, the heat generation layer 230 may have a heat-generative resistance member formed from Ta—Al through a vacuum deposition process, and the electrode may be formed by depositing Al.

Figure 4C:
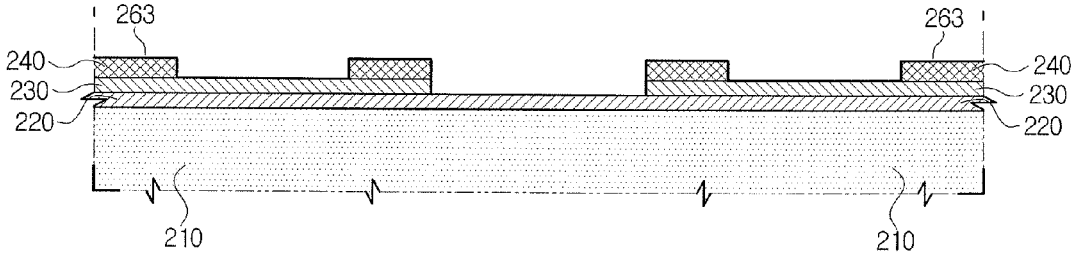

When the deposition of the heat generation layer 230 and the electrode layer 240 is completed, surface treatment is performed on the top surfaces of the heat generation layer 230 and the electrode layer 240 by applying plasma to the top surfaces, as illustrated in FIG. 4C. At this time, gaseous ammonia ($NH_3$) can be introduced into the reaction area. Meanwhile, no practical layer is formed through such surface treatment. In other words, although FIG. 4C may appear to illustrate that a layer is formed at reference numeral 263 on the top surfaces of the heat generation layer 230 and the electrode layer 240, reference numeral 263 is not a formed layer, but is only illustrated in FIG. 4C in order to help understanding of where the stuffing treatment to remove defects and to improve bonding occurs.

Figure 4D:
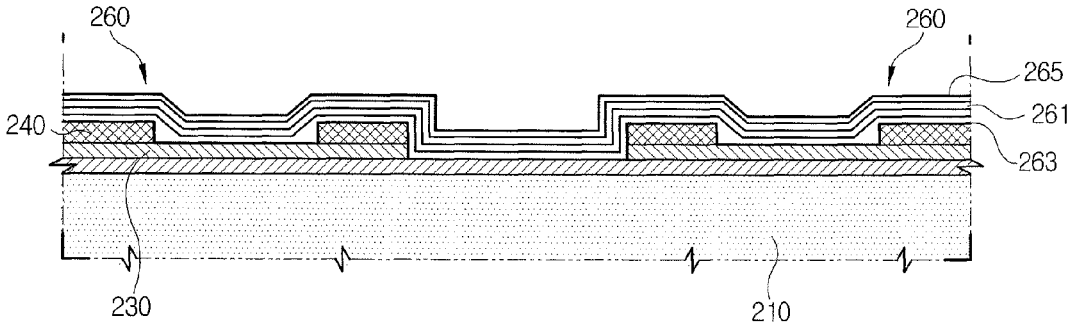

When the surface treatment of the top surfaces of the heat generation layer 230 and the electrode layer 240 is completed, the first protective layer 260 is deposited as illustrated in FIG. 4D. The first protective layer 260 in this embodiment is formed as a multi-layered film structure with plural films 261 being laminated. The respective films 261 can be separately formed from SiNx by repeatedly performing plasma enhanced chemical vapor deposition (PECVD). The plasma enhanced chemical vapor deposition can be employed if the electrode layer 240 is formed from Al. That is, because the melting point of Al is about 600° C., the plasma enhanced chemical vapor deposition performed at about 400° C. is employed so as to prohibit a characteristic change of Al. In such a plasma enhanced chemical vapor deposition process, it is possible that $SiH_3$ or $NH_3$ is used as reaction gas, CCP (Capacitive Coupled Plasma) is used as a plasma, and plural frequency generators are employed so that RF (Radio Frequency, 13.56 MHz) and LF (Low Frequency, 400 kHz) can be concurrently applied. It is also possible that the pressure at the time of reaction is controlled using $N_2$ gas.

Meanwhile, it is possible that the respective top surfaces of the films 261 are subject to stuffing treatment (265) by applying plasma to the surfaces similar to the stuffing treatment applied to the top surfaces of the heat generation layer 230 and the electrode layers 240. The plasma applied to the top surfaces of the films 261 can be CCP, and can also be CCP with ammonia ($NH_3$) being used as a reaction gas. By this stuffing treatment, it is possible to remove defects, such as pinholes, formed in each of the films 261. In addition, each of the films 261, which were subjected to stuffing treatment, respectively serves as a seed layer to render another film 261 to be rigidly bonded to its top surface and to facilitate the deposition of a next film 261. It is to be noted that although it appears in FIG. 4D that reference numeral 265 is a separate layer formed on each of the films 261, reference numeral 265 is only provided to aid in pointing out where the stuffing treatment occurs, and no practical layer is separately formed through such stuffing treatment.

Figure 4E:
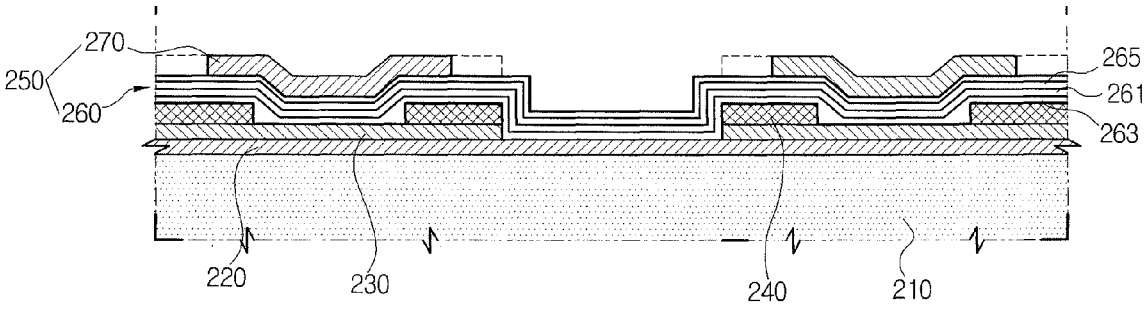
Figure 4F:
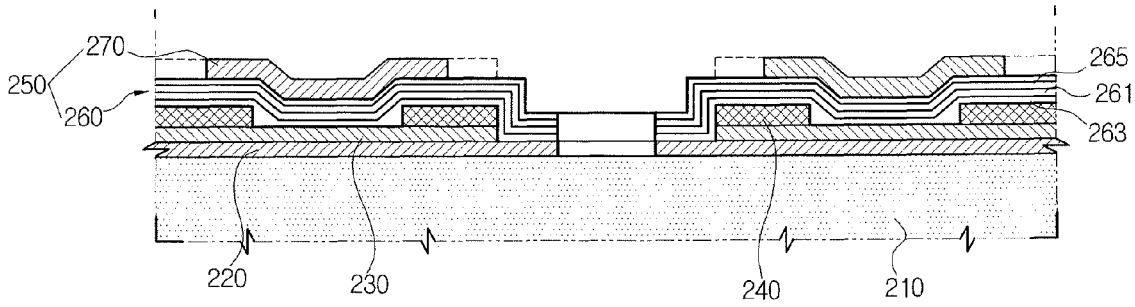

When the deposition of the first protective layer 260 is completed, the second protective layer 270 can be formed thereby completing the protective layer 250, and the second protective layer 270 is patterned to a predetermined shape, as illustrated in FIG. 4E. It is possible that the second protective layer 270 is formed by depositing either Ta or TaNx on the top surface of the first protective layer 260. With reference to FIG. 4F, part of the first protective layer 260 and the heat insulation layer 220 is etched to form an ink supply passage 217.

Accordingly, the ink supply passage 217 is formed at an area where the heat generation layer 230 and the electrode layer 240 are not formed.

Figure 4G:
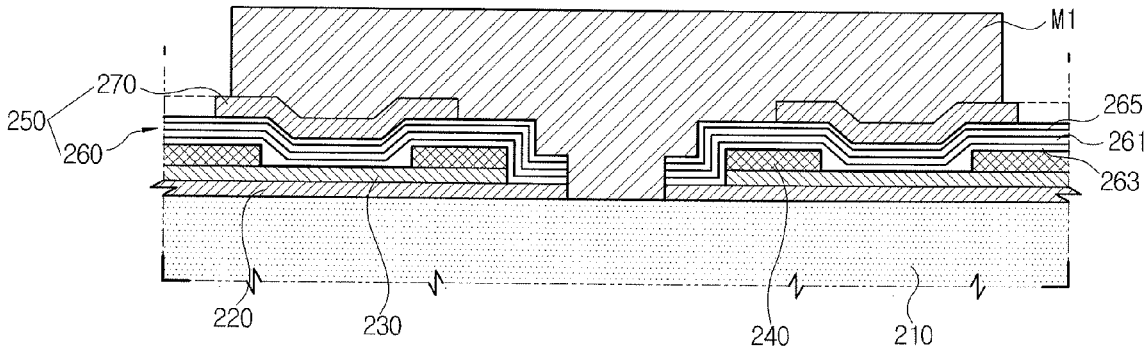

FIG. 4G illustrates an operation in which a photoresist mold (M1) is laminated on the top surface of the second protective layer 270 and then patterned.

Figure 4H:
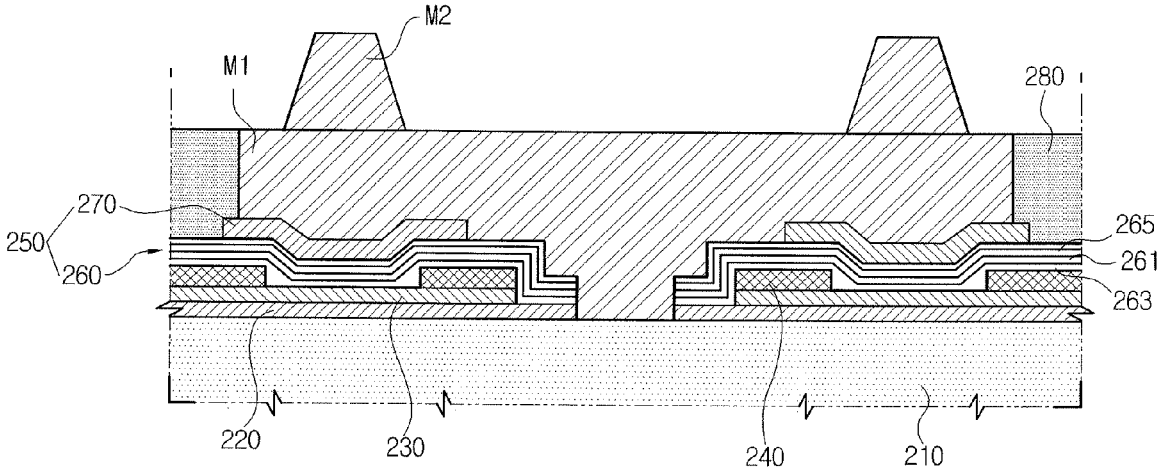

When the patterning of the photoresist mold M1 as described above is completed, a metallic material is electroplated or an epoxy is deposited on the etched area of the photoresist mold M1, thereby forming an ink chamber barrier 280, as illustrated in FIG. 4H. The process of forming such an ink chamber barrier 280 using a photoresist mold M1 as described above is called as a monolithic laminating process, which can facilitate miniaturization and integration of the ink print head 200 (FIG. 2). Meanwhile, if the ink chamber barrier 280 is formed through such a monolithic laminating process as described above, it is preferable that a nozzle plate 290 with a nozzle 295 can also be formed through such a monolithic laminating process using a patterned photoresist mold M2. If such a monolithic laminating process is not employed, the ink chamber barrier 280 and the first protective layer 260 can be bonded with each other using an additional adhesive layer (not illustrated).

Figure 4I:
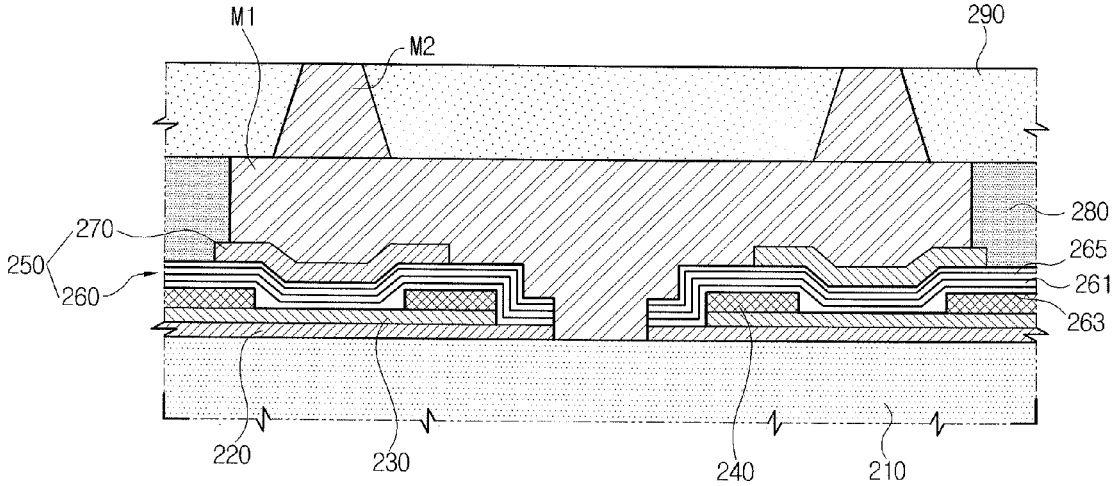
Figure 4J:
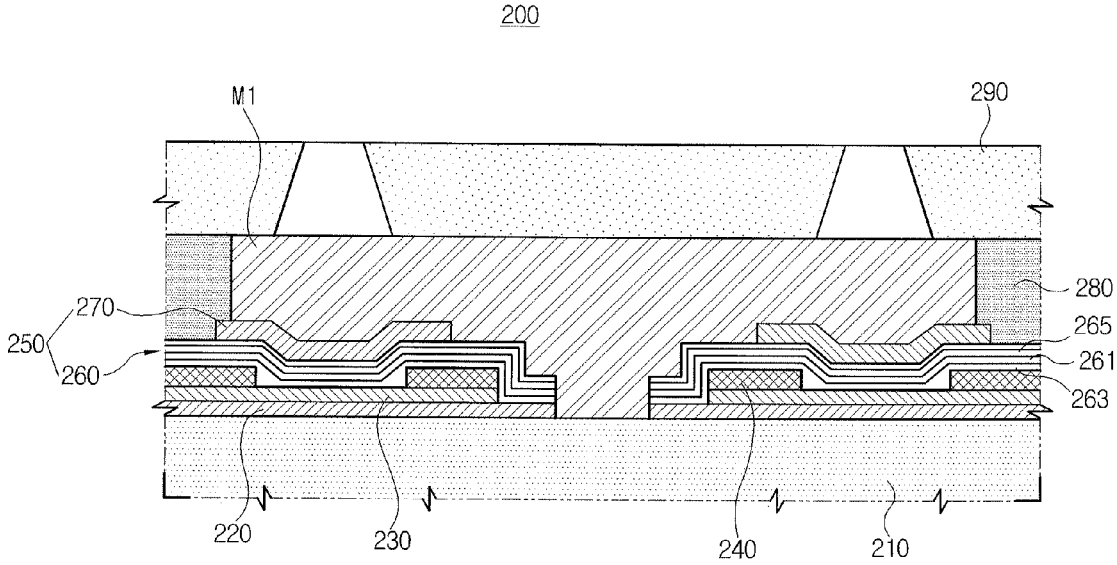
Figure 4K:
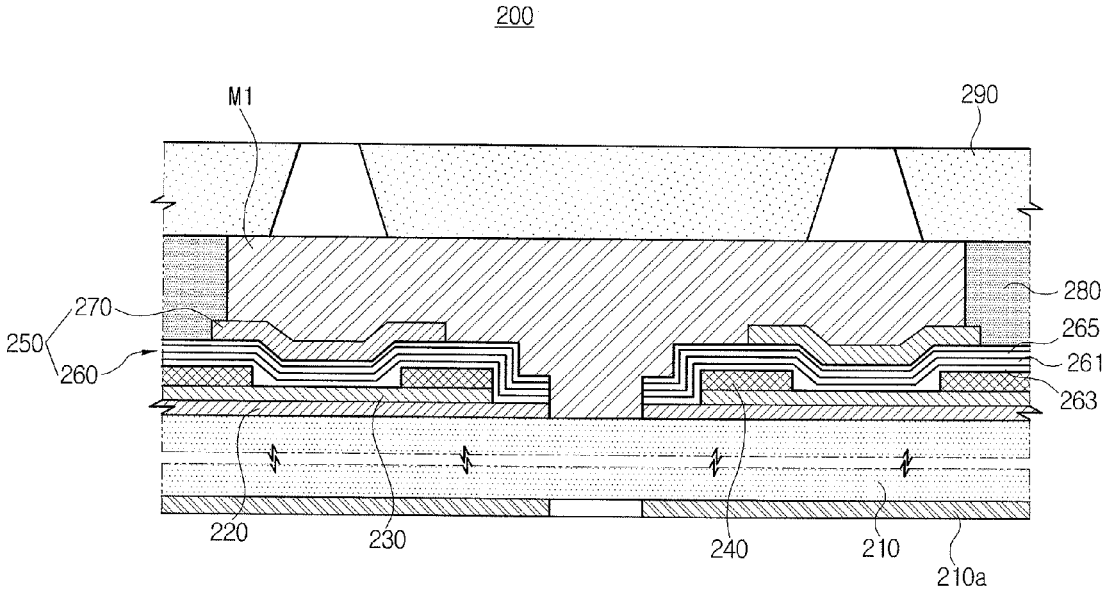
Figure 4L:
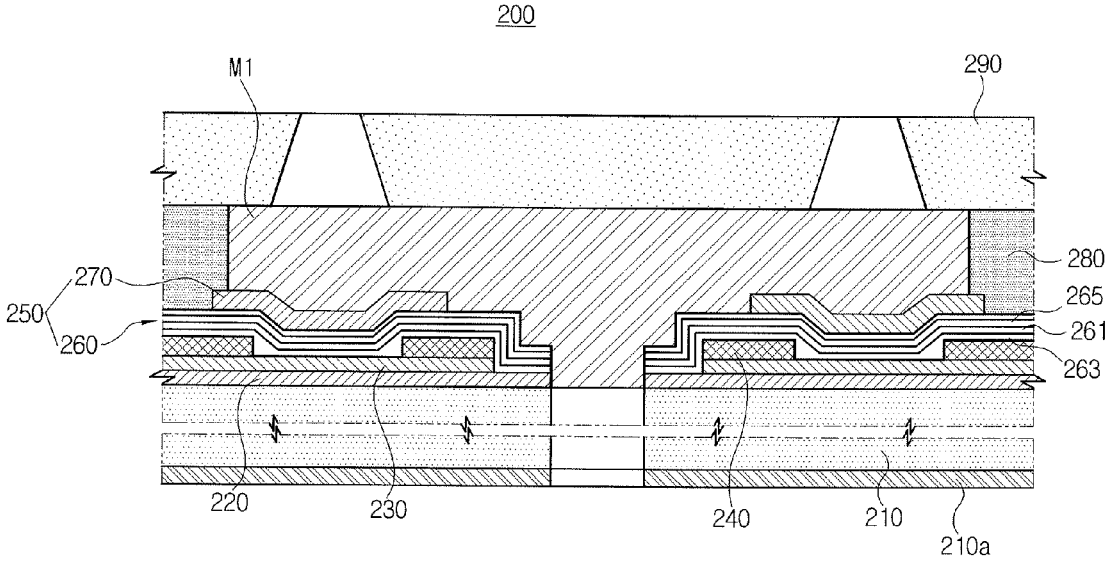
Figure 4M:
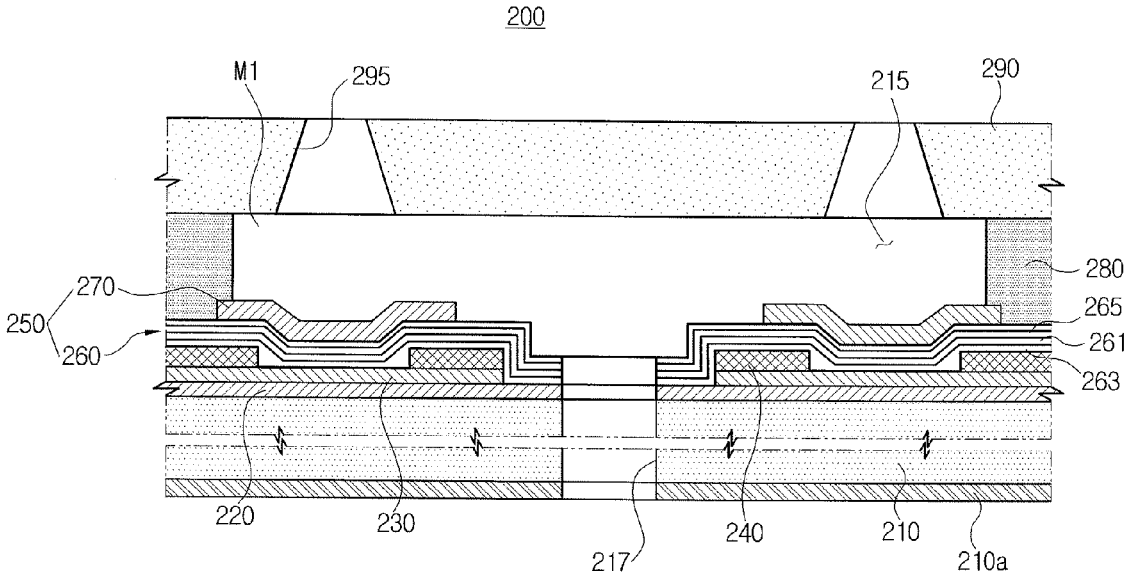

When the lamination of the nozzle plate 290 is completed as illustrated in FIG. 4H, the photoresist molds M1 is subject to wet etching and removed to form an ink chamber 215 as illustrated in FIG. 4J. With reference to FIG. 4K, a patterned layer 210*a*, having a pattern of the formation area of the ink supply passage 217, is laminated on the bottom of the main substrate layer 210. The ink supply passage 127 as illustrated in FIG. 4I is penetrated through the main substrate layer 210, by etching the main substrate layer 210 through the pattern of the pattern layer 210*a*. It is desirable that the ink supply passage 217 be formed by dry etching. With reference to FIG. 4M, after the etching of the ink supply passage 217 through the main substrate layer 210, the ink chamber 215 is formed and connected with the ink supply passage 217 of the main substrate layer 210 by removing the photo resist mold M1 by chemical etching. The patterned layer 210*a* is removed from the main substrate layer 210 and disposed, after the ink supply passage 217 is formed.

Figure 7:
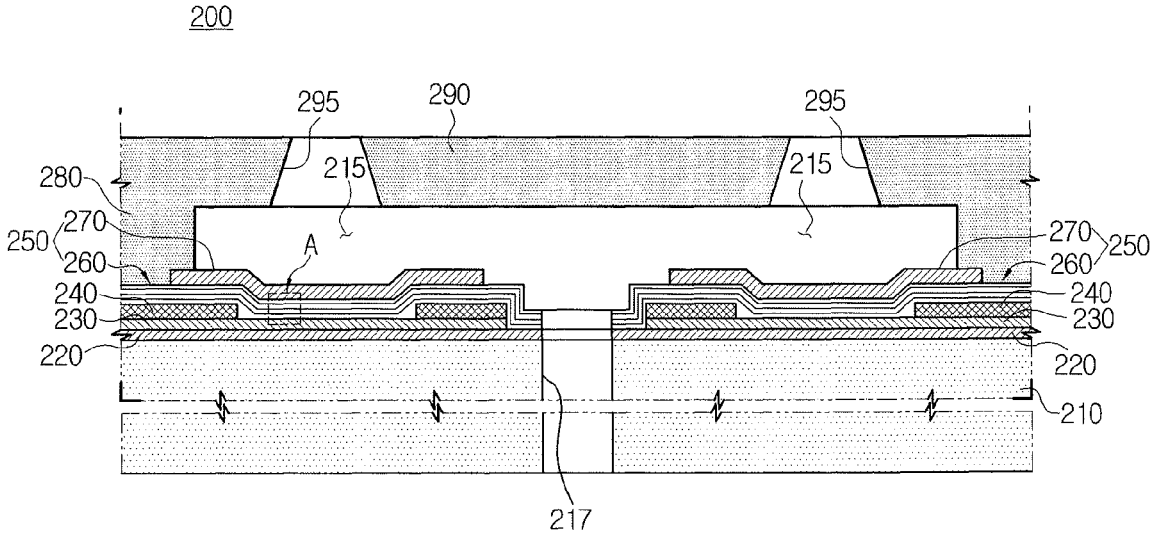
FIG. 7 is a cross-sectional view illustrating an ink chamber barrier and a nozzle plate being integrally formed with each other according to an embodiment of the present general inventive concept.

The ink chamber barrier 280 and the nozzle plate 290 may be provided separately from each other, or alternatively, may be formed integrally with each other as illustrated in FIG. 7. With reference to FIG. 7, the ink chamber barrier 280 and the nozzle plate 290 may be provided as one body, which has a space for the formation of the ink chamber 215. The integral structure of the ink chamber barrier 280 and the nozzle plate 290 is laminated to cover the protective layer 250 after the protective layer 250 is formed. Nozzles 295 are then formed in the predetermined locations, by a separate etching process.

Hereinbelow, an ink-jet print head according to another embodiment of the present general inventive concept is described with reference to FIGS. 5 and 6.

Figure 5:
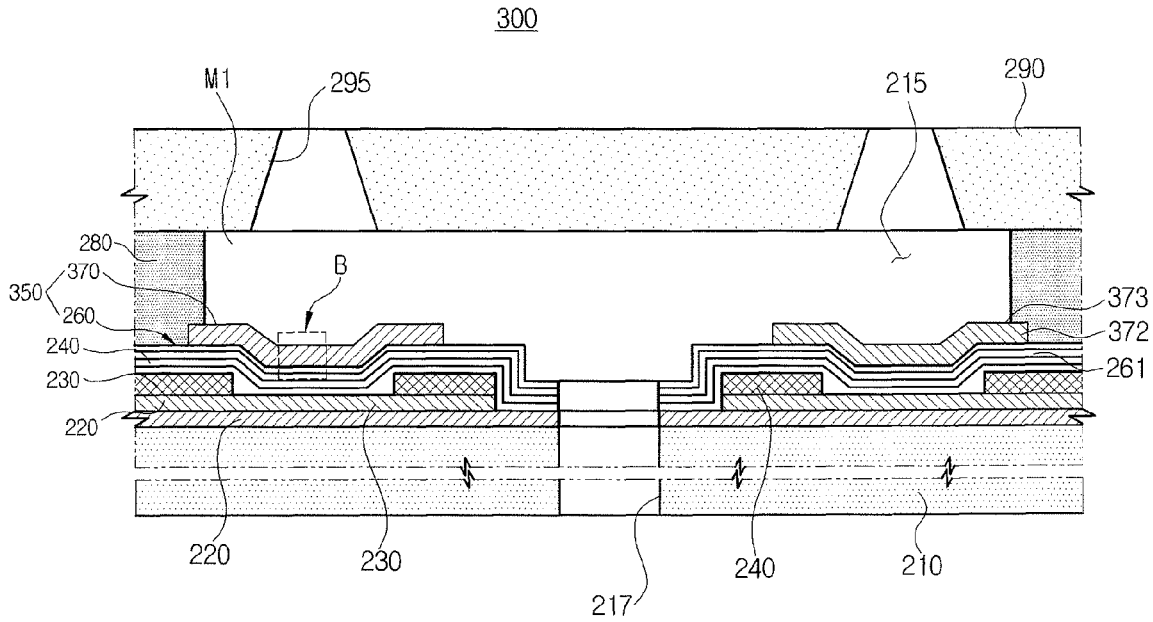
FIG. 5 is a cross-sectional view illustrating an ink-jet print head according to another embodiment of the present general inventive concept.
Figure 6:
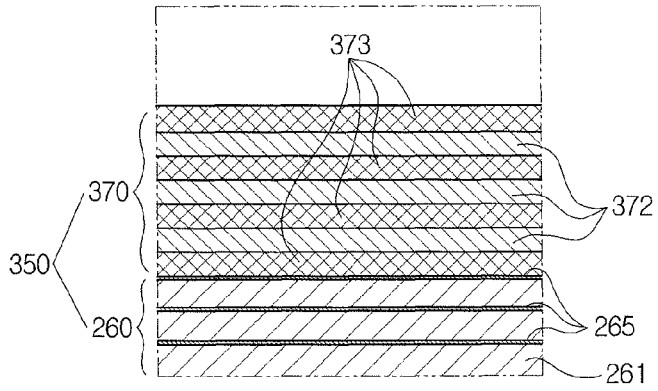
FIG. 6 is an enlarged view illustrating part B of FIG. 5.

Referring to FIG. 5, the ink-jet print head 300 according to this embodiment is characterized in that a first protective layer 360 has a multi-layered film structure similar to the first protective layer 260 described above, and a second protective layer 370 is formed in a multi-layered film structure, to form a resultant protective layer 350. This is because various properties necessarily required to protect the heat generation layer 230, such as hardness, elasticity, and anti-oxidation cannot be satisfied with a second protective layer 370 formed from a single material (see FIG. 1). That is, if such a second protective layer 370 is formed from Ta only, it is superior in elasticity but can not meet the requirements for hardness and anti-oxidation. Whereas, if such a second protective layer 370 is formed from TaNx only, it is superior in hardness and anti-oxidation but cannot meet the requirements for elasticity. Therefore, in order to solve these problems, the second protective layer 370 according to this embodiment is formed by alternately laminating plural first films 372 and plural second films 373. According to this process, the second protective layer 370 is improved in terms of elasticity, hardness and anti-oxidation, as compared to the conventional second protective 170 (see FIG. 1) formed from a single material. The first films 372 are formed through a sputtering process and the second films 373 are formed through a reactive sputtering process, in which $N_2$ gas is introduced and reacted when sputtering Ta.

Furthermore, the lowermost surface of the second protective layer 370 is preferably formed with a second film 373. By this process, the bonding force between the first protective layer 360 and the second protective layer 370 is enhanced. In addition, the uppermost surface of the second protective layer 370 is preferably formed by a second film 373. According to this process, it is possible to prohibit the oxidation of the second protective layer 370 caused by ink supplied into the ink chamber 215. Meanwhile, the remaining technical configuration of the ink-jet print head except the second protective layer 370 is identical to that of the ink-jet print head 200 (see FIG. 2) of the afore-mentioned previous embodiment. Therefore, a detailed description thereof is omitted.

According to the embodiments of the present general inventive concept as described above, a first protective layer is formed in a multi-layered film structure, thereby prohibiting an occurrence of pinholes in the first protective layer. Accordingly, it is possible to prevent a failure of the first protection layer due to an external force exerted in response to ejection of ink. Consequently, it is possible not only to prohibit the failure of a heat generation layer due to such an external force but also to prevent the heat generation layer or an electrode layer from being electrically shorted with the ink contained within an ink chamber or a second protective layer. To this end, the duration and quality of an ink-jet print head can be enhanced.

Moreover, because the second protective layer is also formed in a multi-layered film structure, the heat generation layer can be more effectively protected.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An ink-jet print head comprising:

a main substrate;

an ink chamber formed on the main substrate;

a heat generation layer laminated on a bottom surface of the ink chamber;

an electrode layer laminated on a top surface of the heat generation layer; and a protective layer laminated on top surfaces of the electrode layer and the heat generation layer, wherein the protective layer comprises a first protective layer laminated on the top surfaces of the heat generation layer and the electrode layer and a top surface of the first protective layer is subject to surface treatment by applying a plasma thereto to remove pinholes from the top surface of the first protective layer so that the top surface is devoid of pinholes, and wherein the heat generation layer and the electrode layer were subjected to surface treatment to remove pinholes by applying the plasma to the top surfaces thereof.

2. The ink-jet print head of claim 1, wherein the first protective layer comprises at least two films sequentially laminated on the top surfaces of the heat generation layer and the electrode layer, and top surfaces of the at least two films are respectively subject to surface treatment by applying a plasma to the top surfaces thereof.

3. The ink-jet print head of claim 2, wherein all of the at least two films essentially consist of SiNx, and a reaction gas used when applying the plasma is ammonia ($NH_3$).

4. The ink-jet print head of claim 1, wherein each of the at least two films has a thickness in the range of about 100~1100 Å.

5. The ink-jet print head of claim 1, wherein the protective layer further comprises a second protective layer laminated on the top surface of the first protective layer.

6. The ink-jet print head of claim 1, wherein the second protective layer comprises at least two films formed from different materials, wherein the at least two films are alternately laminated on the top surface of the first protective layer.

7. The ink-jet print head of claim 6, wherein the second protective layer comprise plural first films and plural second films alternately laminated on the top surface of the first protective layer, wherein the first films essentially consist of Ta and the second films essentially consist of TaNx, and wherein the uppermost and the lowermost of the second protective layer are formed with the second films.

8. An ink-jet print head comprising:

a main substrate;

an ink chamber formed on the main substrate;

a heat generation layer formed on a bottom surface of the ink chamber;

an electrode layer formed on a top surface of the heat generation layer; and a plurality of first protective layers formed on top surfaces of the electrode and heat generation layer, wherein the top surface of each of the plurality of first protective layers is devoid of pinholes, and wherein the heat generation layer and the electrode layer were subjected to surface treatment to remove pinholes by applying the plasma to the top surfaces thereof.

9. The ink-jet head of claim 8, further comprising:

a plurality of second protective layers formed on a top surface of the plurality of first protective layers, comprising at least two different materials.

10. The ink-jet head of claim 9, wherein the plurality of second protective layers comprise a plurality of first films comprising a first material, and a plurality of second films comprising a material different from the first material, alternately laminated on the top surface of the first protective layer.

11. The ink-jet head of claim 10, wherein the uppermost layer and the lowermost layer of the plurality of second protective layers are formed with the same material.

* * * * *